US006658692B2

(12) United States Patent
Lenkiewicz et al.

(10) Patent No.: US 6,658,692 B2
(45) Date of Patent: Dec. 9, 2003

(54) SMALL AREA DEEP CLEANER

(75) Inventors: Kenneth M. Lenkiewicz, Grand Rapids, MI (US); Alan J. Krebs, Pierson, MI (US); Timothy E. Kasen, Jenison, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 10/064,604

(22) Filed: Sep. 12, 2002

(65) Prior Publication Data

US 2003/0005545 A1 Jan. 9, 2003

Related U.S. Application Data

(62) Division of application No. 09/755,724, filed on Jan. 5, 2001, now Pat. No. 6,467,122.
(60) Provisional application No. 60/176,380, filed on Jan. 14, 2000.

(51) Int. Cl.[7] ..... A47L 11/30
(52) U.S. Cl. ..... 15/320; 15/339
(58) Field of Search ..... 15/320, 339

(56) References Cited

U.S. PATENT DOCUMENTS

| | | | | | |
|---|---|---|---|---|---|
| 2,246,111 | A | | 6/1941 | Snyder | 15/320 |
| 3,029,461 | A | * | 4/1962 | Osborn | 15/320 |
| 3,101,505 | A | | 8/1963 | Belicka et al. | 15/320 |
| 3,540,072 | A | | 11/1970 | Wolter et al. | 15/320 |
| 4,559,665 | A | | 12/1985 | Fitzwater | 15/339 |
| 4,724,573 | A | * | 2/1988 | Ostergaard | 15/321 |
| 5,287,587 | A | * | 2/1994 | Yonkers et al. | 15/320 |
| 5,406,673 | A | * | 4/1995 | Bradd et al. | 15/320 |
| 5,500,977 | A | | 3/1996 | McAllise et al. | 15/320 |
| 6,065,182 | A | * | 5/2000 | Wright et al. | 15/320 |
| 6,154,917 | A | | 12/2000 | Zahuranec et al. | 15/320 |
| 6,158,081 | A | | 12/2000 | Kasen et al. | 15/320 |
| 6,167,587 | B1 | | 1/2001 | Kasper et al. | 15/320 |

* cited by examiner

*Primary Examiner*—Theresa T. Snider
(74) *Attorney, Agent, or Firm*—McGarry Bair PC

(57) ABSTRACT

An upright deep cleaner including a base housing pivotally connected to an upright handle, the upright handle carrying a liquid supply tank and the base housing including a recovery tank. The liquid supply tank includes an internal siphon tube for ensuring liquid flow to a feed valve when the upright handle is in the inclined position. The base housing includes a suction nozzle adjacent a spray bar, and removable floating brush for contacting a surface being cleaned, the brush being interchangeable with a bare floor tool including a sponge, brush, and squeegee. The recovery tank includes an internal baffle for preventing foaming of solution and a tank vent housing including a sponge-type filter to prevent spray from exiting the recovery tank.

32 Claims, 15 Drawing Sheets

SMALL AREA DEEP CLEANER

CROSS REFERENCE TO RELATED APPLICATIONS

This application is a divisional of U.S. patent application Ser. No. 09/755,724, filed Jan. 5, 2001 now U.S. Pat. No. 6,467,122, which claims the benefit of provisional patent application Serial No. 60/176,380, filed Jan. 14, 2000.

BACKGROUND OF INVENTION

1. Field of the Invention

This invention relates to a water extraction cleaning machine and, more particularly, an upright water extraction cleaning machine 2. Description of the Related Art Water extraction cleaning machines have been used for removing dirt from surfaces such as carpeting, upholstery, drapes and the like. The known water extraction cleaning machines can be in the form of a canister-type unit as disclosed in U.S. Pat. No. 5,237,720 to Blase et al. or an upright unit as disclosed in U.S. Pat. No. 5,500,977 to McAllise et al. and U.S. Pat. No. 4,559,665 to Fitzwater.

SUMMARY OF INVENTION

According to the invention, a portable surface cleaning apparatus comprises a base housing adapted for movement along a surface to be cleaned, an upright handle pivotally mounted to the base module, a liquid dispensing system and a dirty liquid recovery system. The liquid dispensing system comprises a liquid dispenser associated with the base module for applying liquid to a surface to be cleaned, a liquid supply tank removably mounted to the handle for holding a supply of cleaning liquid and a liquid supply conduit fluidly connected to the liquid supply tank and to the dispenser for supplying liquid to the dispenser. The liquid recovery system comprises a recovery tank removably mounted on the base housing and having a liquid recovery chamber for holding recovered liquid, a suction nozzle associated with the base housing and adapted to draw dirty liquid from the surface to be cleaned, a working air conduit extending between the recovery chamber and the suction nozzle and a vacuum source in fluid communication with the recovery chamber for generating a flow of working air from the nozzle through the working air conduit and through the recovery chamber to thereby draw dirty liquid from the surface to be cleaned through the nozzle and working air conduit, and into the recovery chamber to thereby recover the dirty liquid from the surface to be cleaned.

In one embodiment of the invention, a supply tank mounting assembly on a rear side of the handle and on a front side of the liquid supply tank removably mounts the liquid supply tank to the rear side of the handle. In a preferred embodiment of the invention, the supply tank mounting assembly comprises a pair of spaced mounting rails on the rear side the handle and a pair of spaced mounting rails on the liquid supply tank adapted to interface with the handle mounting rails to slidably mount the liquid supply tank to the rear side of the handle.

The supply tank has an outlet opening in a lower portion thereof and a cap is removably mounted, typically with threads, in the outlet opening. A siphon tube is mounted to the cap and has a free end distal from the cap. The siphon tube is bent into a shape so that the free end of the siphon tube is adjacent the side wall at a low point in the interior of the tank when the handle is tilted in use.

A vent hole is preferably provided in the liquid supply tank at an upper portion of the front side thereof for venting air into the supply tank.

In a preferred embodiment of the invention, the liquid supply tank has an elongated shape in a vertical direction when the handle is in an upright position and smoothly conforms to the shape of the handle to an appearance of being integrated therewith. The liquid supply tank front side has a relatively flat front portion and the handle has a recessed rear wall complementary to the flat front portion of the liquid supply tank. The relatively flat front portion of the supply tank front side is received in the recessed rear wall of the handle. The rear wall of the liquid supply tank has a concave outward shape. The front face has a fill opening at a central portion thereof whereby the supply tank can be filled while oriented horizontally. A fill cap/measure is removably mounted, typically with threads, in the fill opening. The fill cap/measure has on an interior end a cavity that has a predetermined capacity related to a predetermined volume in the liquid supply tank whereby the fill cap/measure serves as a measuring container for cleaning solution that is added to the predetermined volume of clean water in the liquid supply tank to form a solution of a desired concentration in the liquid supply tank.

Furthermore, the liquid supply tank has measuring indicia on the tank to indicate when the tank has been filled to the predetermined volume. The measuring indicia comprises a mark on an upper portion of a wall of the liquid supply tank to indicate the predetermined volume when the tank is in an upright position. The measuring indicia further comprises a mark in a vertical direction along a side wall of the liquid supply tank near the front side thereof to indicate the predetermined volume when the tank is in a horizontal fill position. The supply tank is at least partially translucent or transparent so that the level of the liquid in the tank can be observed by an operator.

Preferably, the liquid supply tank has an elongated shape in a vertical direction when the handle is in an upright position and smoothly conforms to the shape of the handle to an appearance of being integrated therewith.

The recovery tank has an outlet opening for passage of air directly to the atmosphere and a filter mounted in the outlet opening. A tank vent is mounted in the recovery tank outlet opening and the filter is mounted in the tank vent. The tank vent is preferably snap-fit into the outlet opening. The recovery tank further includes an inlet opening and the working air conduit is fluidly connected to the inlet opening. The recovery tank further has a diverter in alignment with the inlet opening for breaking up the flow of dirty liquid entering the liquid recovery chamber. The inlet opening is at an upper portion of the recovery tank and a top wall of the recovery tank is shaped to direct the flow of dirty liquid downwardly in the liquid recovery chamber. The recovery tank further has a baffle that is positioned below the inlet opening and diverter. The baffle includes a plurality of openings for passage of dirty liquid and air therethrough. Further, the working air conduit is formed at least in part integrally with the recovery tank.

Further according to the invention, a cord wrap is mounted on the handle assembly for wrapping the cord in a loop, an electrical cord is mounted to the handle adjacent the cord wrap and connected to the vacuum source, and a strain relief collar is mounted on the electrical cord at the handle and aligned with the cord wrap so that the electrical cord is relatively straight and unstressed between the handle and the cord wrap. The strain relief is formed of an elastomeric material.

Further according to the invention, the vacuum source includes an inlet conduit connected to the working air conduit and a grill in the inlet conduit to prevent debris from entering the vacuum source. Further, a flow-restricting baffle upstream from the grill is in the inlet conduit.

Further, according to the invention, the base housing including a cooling air inlet on a lower surface thereof in communication with the vacuum motor. The base housing further comprises a cooling air outlet on a lower portion thereof.

Other objects, features, and advantages of the invention will be apparent from the ensuing description in conjunction with the accompanying drawings.

DETAILED DESCRIPTION

Figure 1:
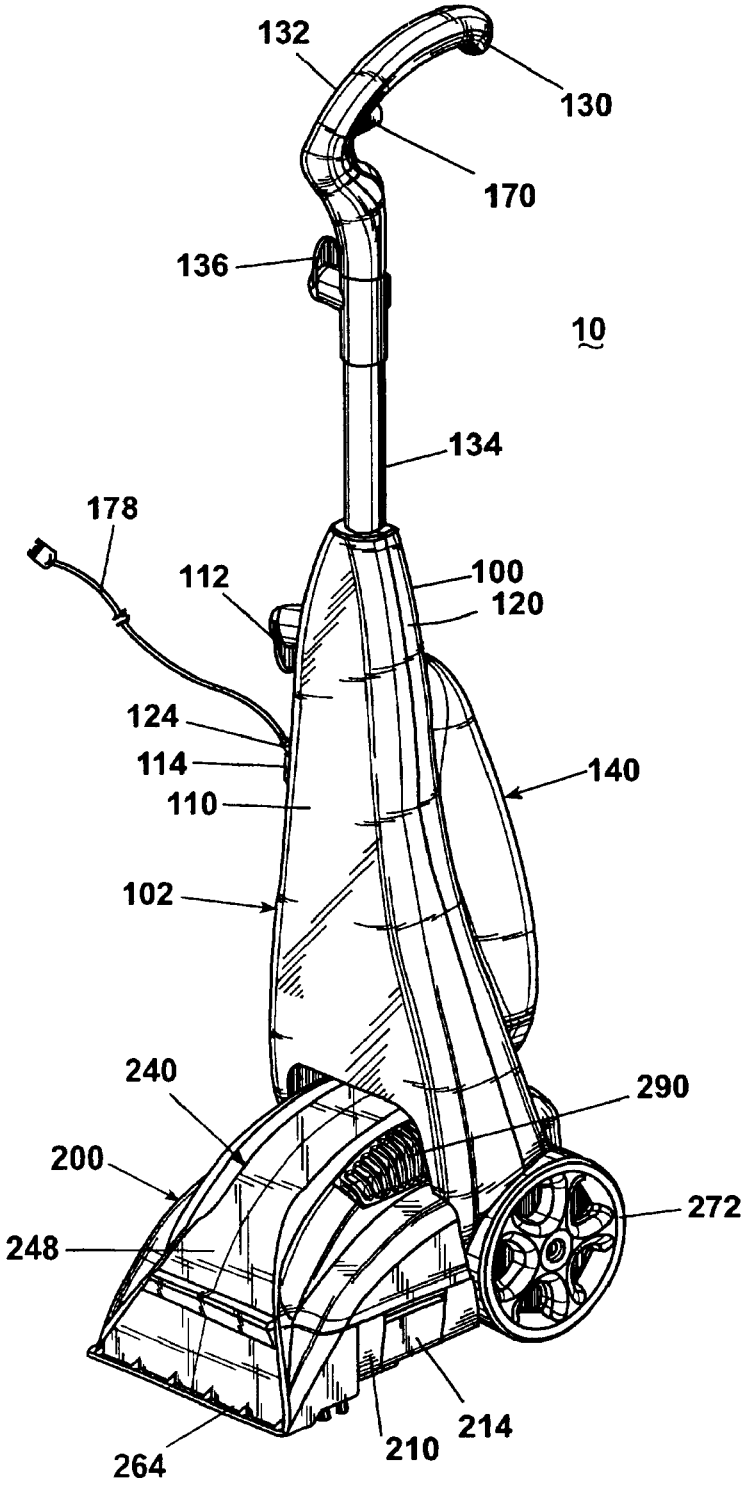
FIG. 1 is a perspective view of a small area deep cleaner according to the invention.

Referring to FIG. 1, a small area deep cleaner 10 according to the invention comprises an upright handle 100 pivotally connected to a floor-traveling head 200. Small area deep cleaner 10 is rollingly supported on a surface by wheels 272 and nozzle 260.

Upright handle 100 includes an upright handle housing 102 comprising front and rear shells 110, 120, a handgrip 130, an upper handle tube 134, and a liquid supply tank 140. Upper cord wrap 136 generally projects from handgrip 130, and lower cord wrap 112 generally projects from housing 102.

Floor-traveling head 200 includes a base housing 210 and a recovery tank assembly 240. Recovery tank assembly 240 is secured to base housing 210 by latches 214.

Figure 2:
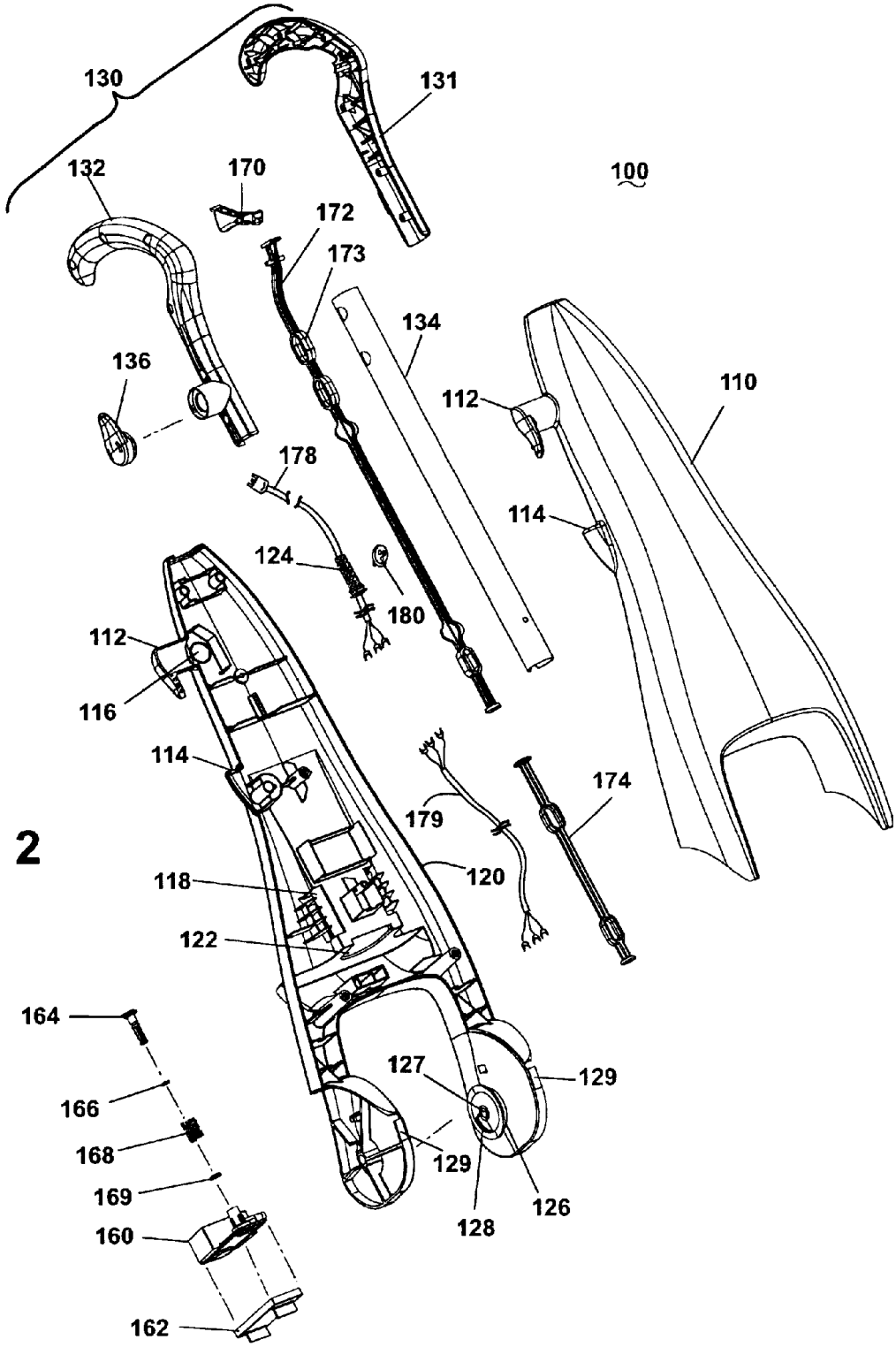
FIG. 2 is an exploded perspective view of an upright handle of the small area deep cleaner of FIG. 1.
Figure 3:
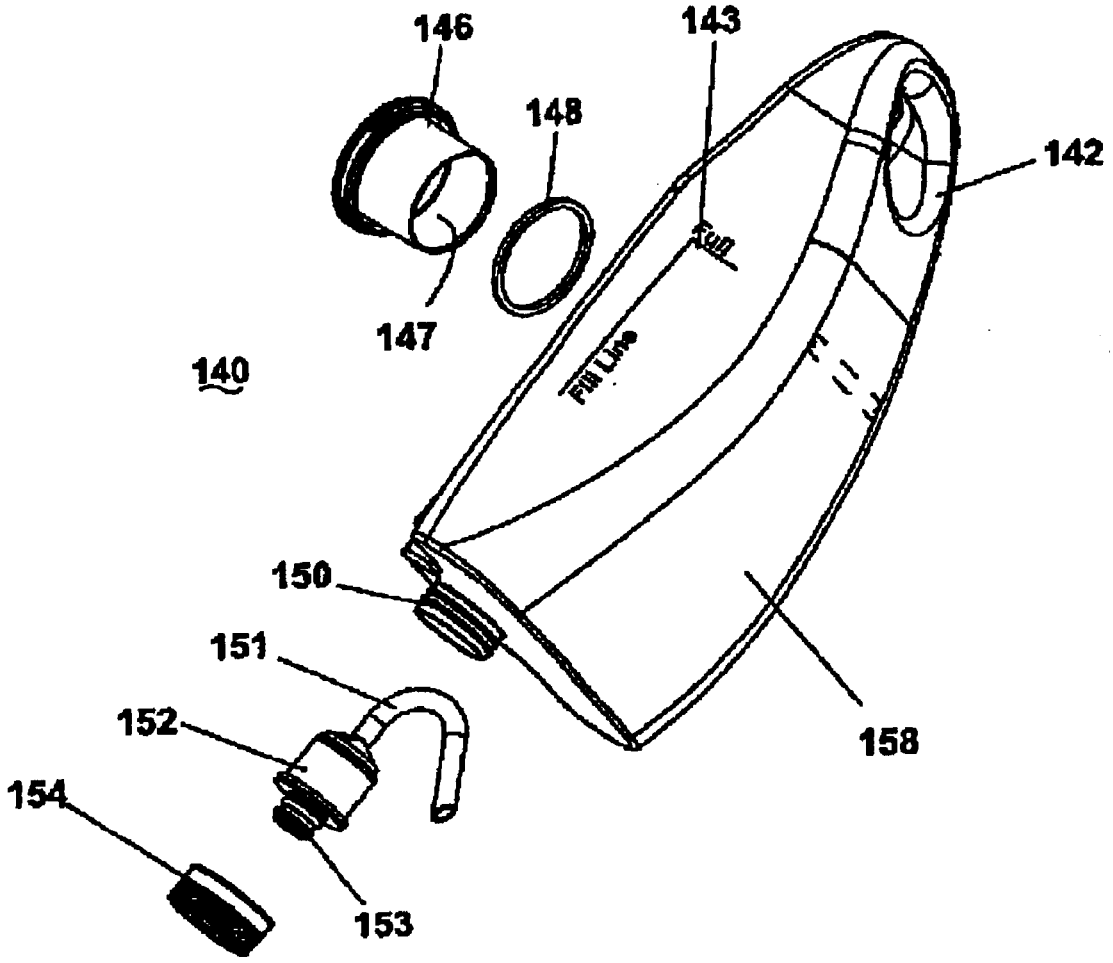
FIG. 3 is an exploded perspective view of a rear face of a liquid supply tank of the small area deep cleaner of FIGS. 1 and 2.
Figure 3A:
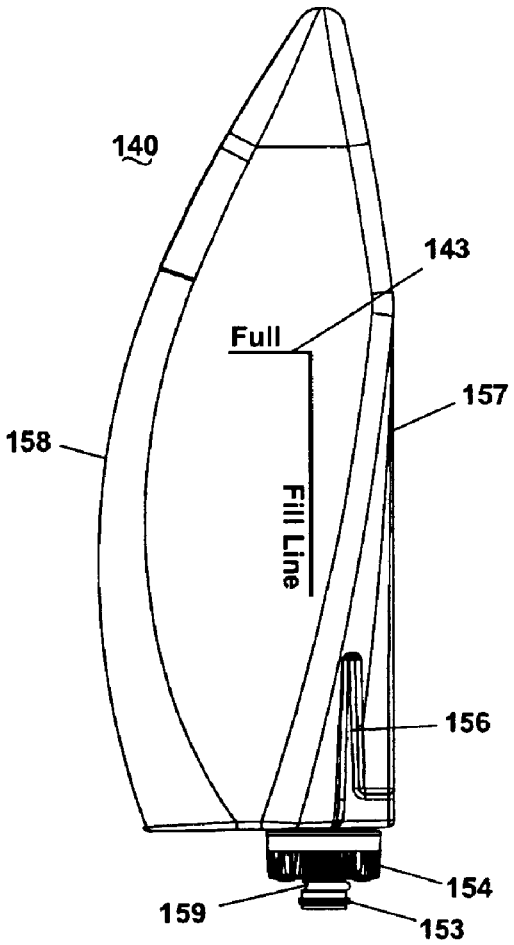
FIG. 3A is a side view of the liquid supply tank of FIG. 3.
Figure 3B:
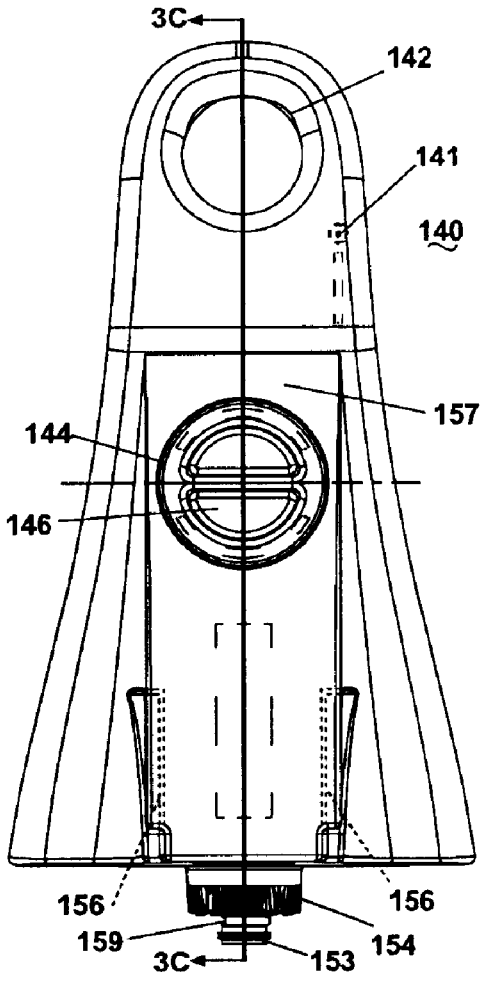
FIG. 3B is a front view of the liquid supply tank of FIGS. 3 and 3A.
Figure 3C:
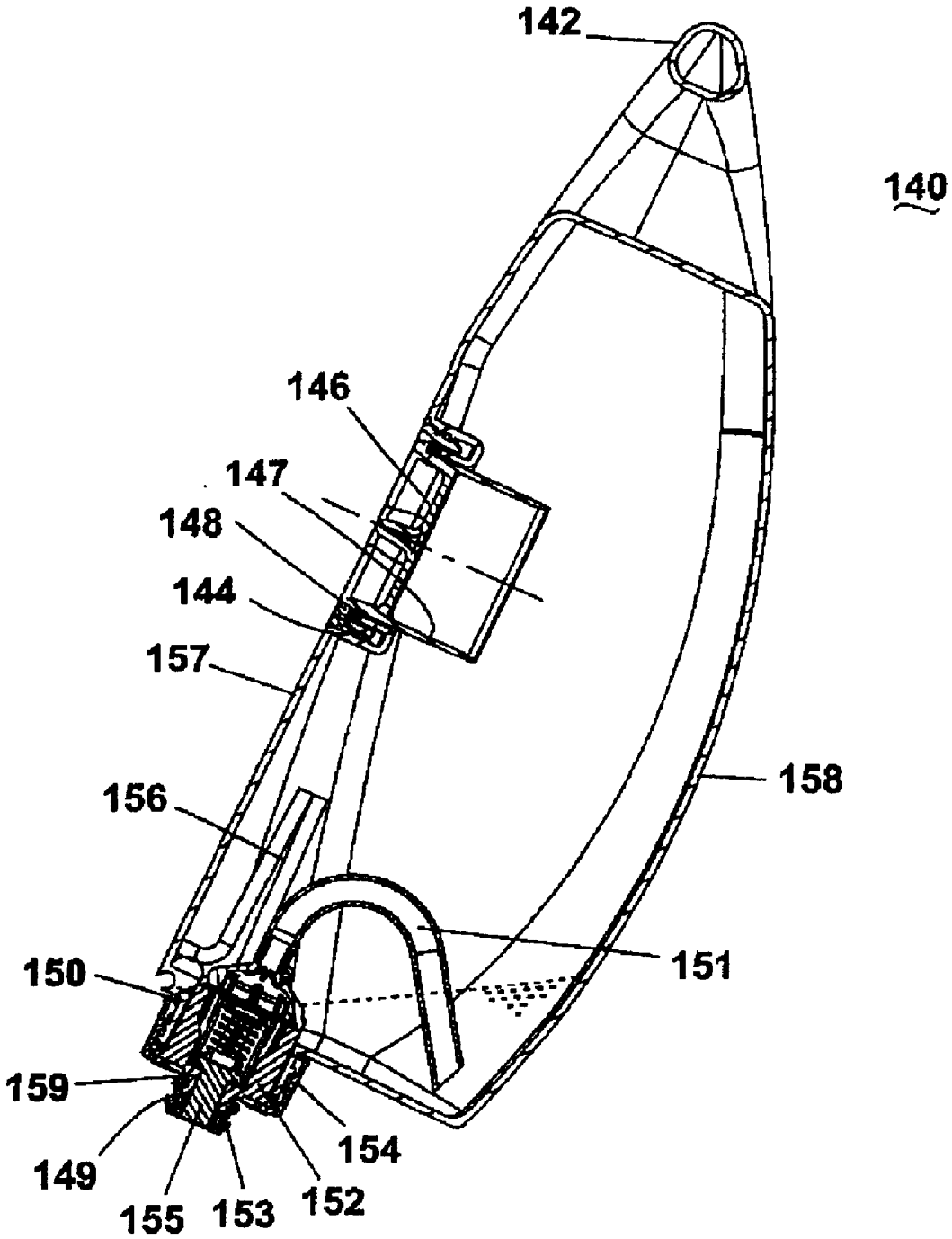
FIG. 3C is a cross-sectional view taken through line 3C—3C of FIG. 3B.

Referring now to FIG. 2, the upright handle 100 comprises front shell 110, rear shell 120, and handgrip 130 comprising first and second handgrip pieces 131, 132. Handgrip 130 is connected to the front and rear shells 110, 120 by upper handle tube 134, with upper handle tube 134 received between each of front and rear shells 110, 120 and first and second handgrip pieces 131, 132, and secured thereto to form the upright handle assembly 100 in combination with the liquid supply tank 140.

Handgrip 130 further comprises a clean solution feed trigger 170 pivotally mounted to and captured between first and second handgrip pieces 131, 132, and upper cord wrap 136 pivotally mounted to second handgrip piece 132. Trigger 170 is adapted to operatively contact the upper end of an upper clean solution feed rod 172 slidably carried within upper handle tube 134 and handgrip 130. Rod 172 includes a number of transverse slot apertures 173 adapted to receive a fastener (not shown) during assembly of the handgrip 130 and upper handle tube 134. Slot aperture 173 and the fastener cooperate to restrict movement of the rod 172 to the range defined by the length of the slot aperture 173 in response to depression of trigger 170; trigger 170 preferably includes a mechanical stop to limit depression of trigger 170 and therefore movement of rod 172. Upper cord wrap 136 is pivotally mounted to second handgrip piece 132, and includes a detent (not shown) for aligning upper cord wrap 136 in a vertical orientation (see FIG. 1) for holding a coil of electrical cord 118 in cooperation with fixed lower cord wrap 112 molded into front and rear shells 110, 120.

Upright handle housing 102 includes front and rear shells 110, 120, each molded to include internal structural features adapted to hold and/or guide working elements of the cleaner 10. Lower cord wrap 112 is composed of a portion extending from a side of each of the front and rear shells 110, 120 that together form lower cord wrap 112 when shells 110, 120 are assembled. A strain relief projection 114 is positioned on a side of shells 110, 120 below and in alignment with lower cord wrap 112. Strain relief projection 114 is adapted to receive an electrical cord strain relief 124 for aligning it with upper and lower cord wraps 136, 112. In assembled form, electrical cord 178 is thus aligned for storage on cord wraps 136, 112.

Figure 1A:
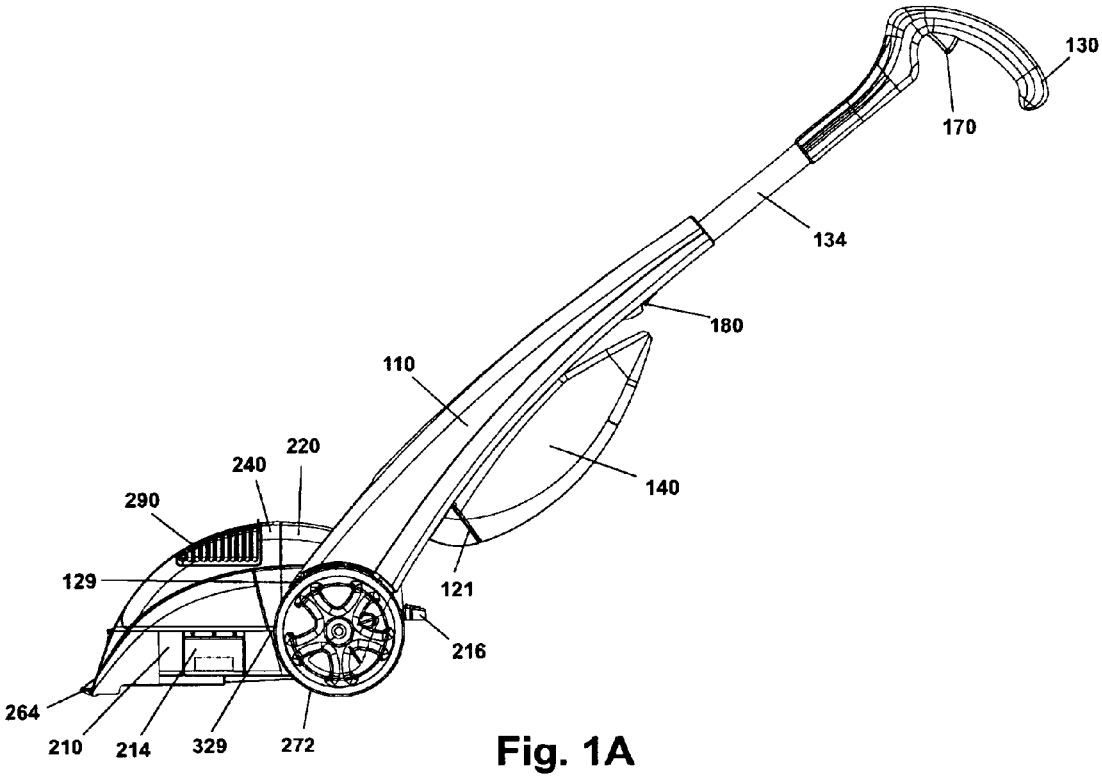
FIG. 1A is a side view of the small area deep cleaner of FIG. 1 with the upright handle in a tilted-back position.

Rear shell 120 includes a power switch aperture 116 opening to a rear face thereof, and a pair of parallel liquid supply tank guide rails 118 arranged above a liquid supply tank support shelf 121 (see FIG. 1A) on a rear face of rear shell 120. An opening 122 is provided in the liquid supply tank support shelf 121.

Referring to FIG. 2, upright handle 100 further comprises an upper clean solution receiver 160, a lower clean solution receiver 162, a flow valve switch 164, a flow valve O-ring 166, a flow valve spring 168, and a flow valve washer 169. The upright handle 100 further comprises a lower clean solution feed rod 174 for operatively connecting upper clean solution feed rod 172 and flow valve switch 164.

Referring now to FIGS. 3 and 3A–C, liquid supply tank 140 is generally hollow and of a blow-molded construction. The tank 140 comprises an integrally formed handle 142, a liquid supply tank fill opening 144, and a liquid supply tank feed opening 150. The liquid supply tank fill opening 144 is located in a central portion on a front surface 157 of the tank 150 and is internally threaded for threaded receipt and retention of a liquid supply tank fill cap/measure 146 with conventional external threads that match the internal threads on the fill opening 144. Intersecting horizontal and vertical indicia fill lines 143 at right angles to each other are printed on a side surface of the liquid supply tank 140 between the handle 142 and the tank feed opening 150 and provide a visual indication to a user of a predetermined tank volume in either an upright or horizontal orientation. Fill cap/measure 146 has an internal cavity 147 which has a measured volume for a user to measure a predetermined amount of cleaning solution for addition to the liquid supply tank 140 in a predetermined proportion to the predetermined tank volume of liquid supply tank 140 as represented by the fill lines 143. To this end the liquid supply tank is molded from a thermoplastic that is at least partially transparent or translucent so that a user can tell when the liquid volume in the tank reaches the fill lines 143. A liquid supply tank fill cap O-ring 148 resides between the fill cap/measure 146 and tank 140 to provide a fluid tight seal. The tank feed opening 150 protrudes from the bottom of tank 140 and is externally threaded.

A liquid supply tank feed valve 152 is sized to be received in the tank feed opening 150 and is held in place by a liquid supply tank feed valve retainer ring 154. Liquid supply tank feed valve 152 includes a projection 159 housing a spring-biased plug 155. A ribbed resilient seal 153 surrounds projection 159, ribs 149 forming an annular seal about the circumference of projection 159 when inserted in a corresponding well in upper clean solution receiver 160. The well of upper clean solution receiver 160 further includes a centered upstanding pin for pushing plug 155 against its spring-bias, thereby opening valve 152. A siphon tube 151 is fluidly connected to liquid supply tank feed valve 152. Siphon tube 151 is adapted to extend toward a bottom portion of a rear face 158 of tank 140 for fluidly connecting that portion of tank 140 through valve 152 to projection 159.

Front surface 157 of tank 140 further includes a vent hole 141 located between the handle 142 and tank fill opening 144. A pair of opposed parallel liquid supply tank mounting rails 156 are molded into the front surface 157 of tank 140 and extend from the area above solution tank feed opening 150 to the liquid supply tank fill opening 144.

Figure 4:
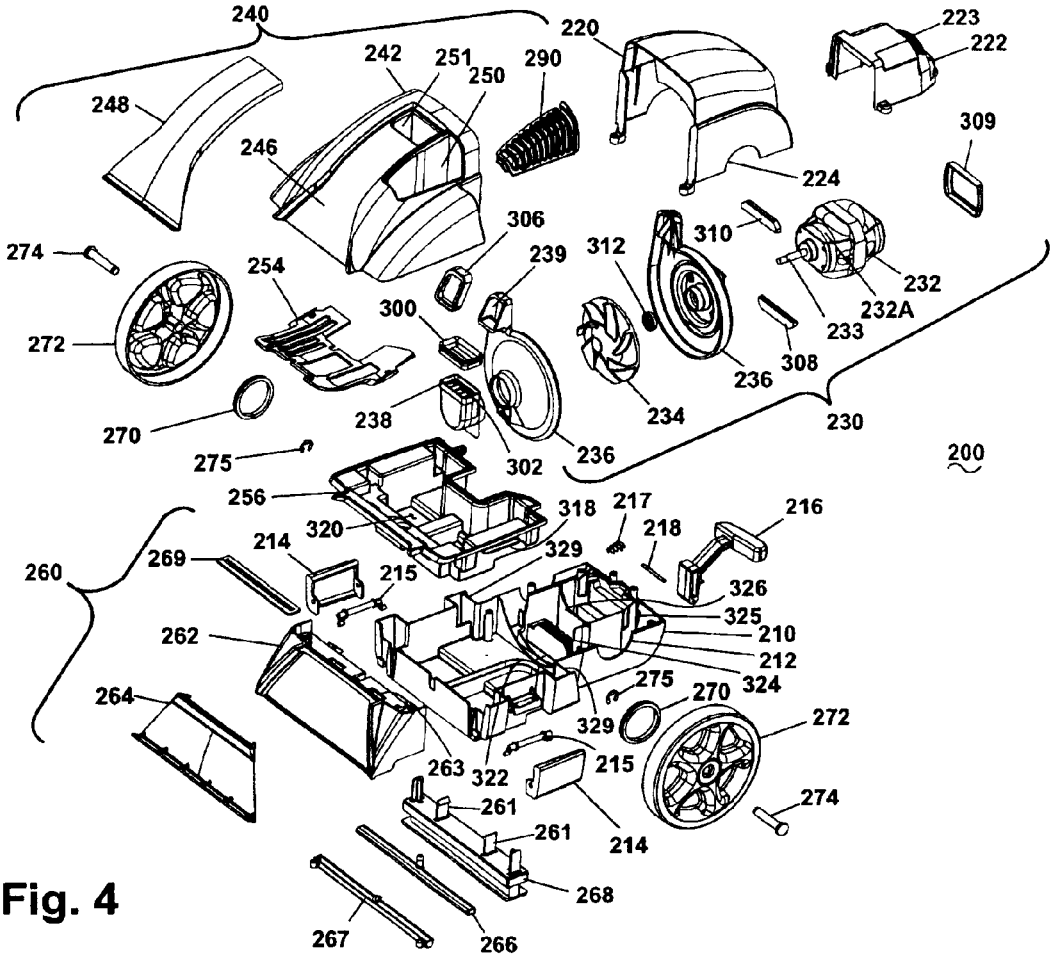
FIG. 4 is an exploded perspective view of a floor-traveling head portion of the small area deep cleaner of FIG. 1.

Referring to FIG. 4, the floor-traveling head 200 comprises a base housing 210, a housing cover 220, a motor/impeller assembly 230, a recovery tank assembly 240, and nozzle assembly 260.

The motor/impeller assembly 230 comprises a motor 232 having a drive shaft 233, motor cooling impeller 232A, motor mounts 308, 309, 310, and an impeller 234 carried within a two-piece impeller shell 236. Impeller shell 236 includes an intake port 238 having ribs 302 across its opening, and an output port 239. Intake port 238 is provided with an intake port gasket 300, which includes a resilient restricting flap 304 for covering a portion of intake port 238. Output port 239 is provided with an output port gasket 306.

Referring particularly to FIGS. 4–10, the recovery tank assembly 240 comprises a tank upper shell 242 and a tank lower shell 256, a baffle 254, a suction channel cap 248, and a tank vent 290. The shells 242, 256 define a tank cavity 258. The upper shell 242 comprises a generally smooth outer surface, except for a longitudinal suction channel 246 on an upper surface of the upper shell 242 (see FIG. 4). An upper end of the suction channel 246 terminates in a vertical passage 251 passing through an extended portion of the material of the upper shell 242 through an outlet opening 253 but not into the tank cavity 258. A second aperture 252 located on a rear portion of the upper shell 242 passes into the cavity 258 (see FIG. 8). A V-shaped diverter 249 is integrally formed on an inside surface of the tank upper shell 242 in axial alignment with the second aperture 252. Opposite the second aperture 252 on an upper face of the upper shell 242, a tank vent opening 250 is adapted to receive the tank vent 290 that provides further passage into the tank cavity 258. The tank vent 290 comprises multiple slots 292 to permit the passage of air, and is molded to closely fit within the tank vent opening 250 and conform to the outer curvature of the tank upper shell 242. One edge of the tank vent 290 is resilient and includes a finger tab 294 (see FIGS. 9–10). An opposing edge of the tank vent 290 includes a recessed extension 296 that cooperates with the opposing resilient edge to hold the tank vent 290 within the opening 250.

The nozzle assembly 260 comprises a nozzle 262, a see-through nozzle lens 264, a spray bar 266, a brush 268, and a nozzle gasket 269.

Figure 12:
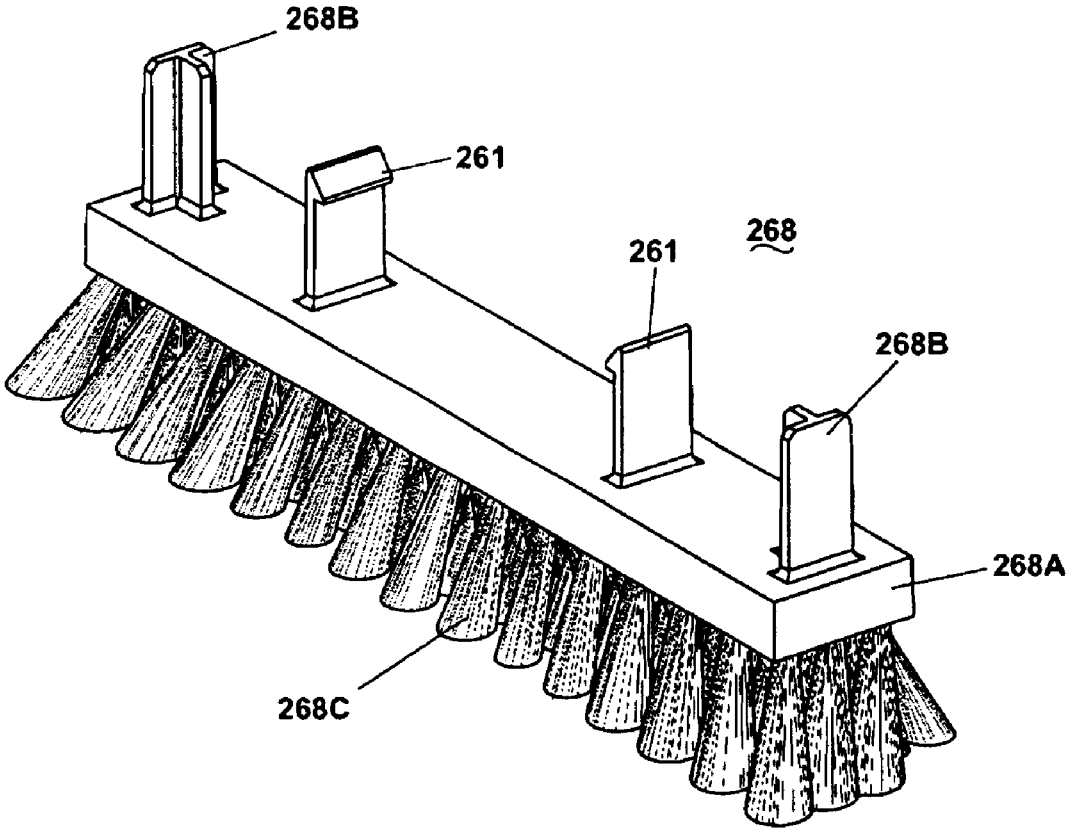
FIG. 12 is a perspective view of a brush for the small area deep cleaner of FIGS. 1–11.
Figure 13:
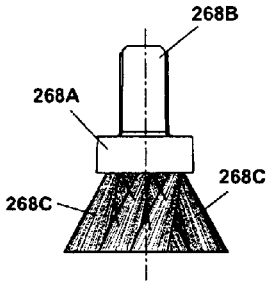
FIG. 13 is an end view of the brush of FIG. 12.
Figure 14:
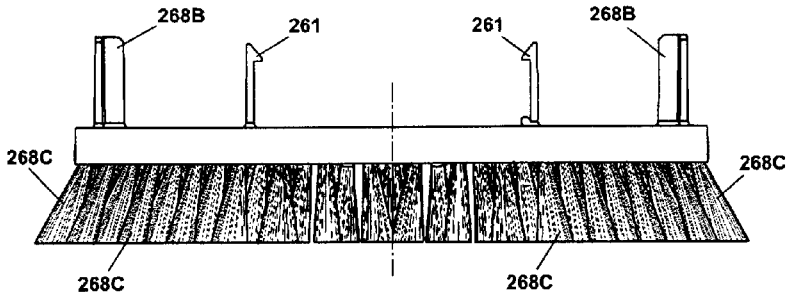
FIG. 14 is a front view of the brush of FIGS. 12–13.
Figure 15:
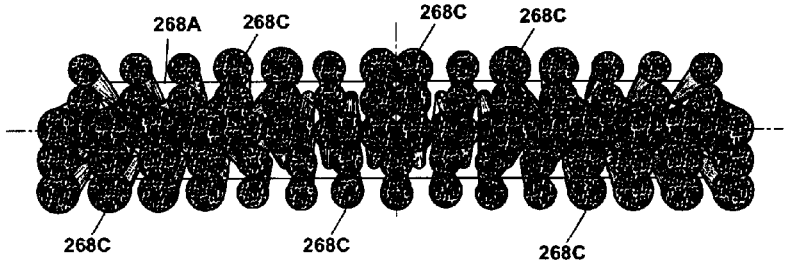
FIG. 15 is a bottom view of the brush of FIGS. 12–14.

The spray bar 266 includes a spray bar cover 267, the spray bar 266 and cover 267 being secured to an inside surface of the front face of the nozzle 262. The spray bar 266 comprises a single inlet and a plurality of outlets evenly spaced across its length. The inlet is fluidly connected with the upper clean solution receiver 160 via a conduit (not shown). The brush 268 removably clips in place on the underside of the nozzle 262 with sufficient clearance such that the brush 268 floats freely in the nozzle 262. The brush 268 comprises a vertical alignment device 268B extending axially from either end of the brush body 268A (see FIG. 12). A resilient clip 261 is located inboard of the alignment device 268B on each end of the brush body 268A. A plurality of bristle bundles 268C extend axially from the brush body 268A in opposition to the resilient clip 261 and alignment device 268B. The bristle bundles 268C are arranged in rows transverse to a longitudinal axis of brush 268. Each row of bristle bundles 268C describes an angle with the vertical centerline of brush 268 (see FIG. 13), with the transverse rows alternating from one side to the other of the longitudinal centerline. In the longitudinal direction (see FIGS. 14–15), the rows of bristle bundles 268C are aligned vertically at the center of the brush body 268A and are canted outwardly at increasing angles from the center to the lateral sides of the brush.

The small area deep cleaner 10 is assembled in the following fashion. The upper clean solution feed rod 172 is inserted in the upper handle tube 134 so that a portion projects above the upper end of the handle tube 134. The first and second hand grip pieces 131, 132 are then assembled over the upper end of the upper handle tube 134 and the upper cleaner solution feed rod 172, enclosing the tube 134 and rod 172. Further, the clean solution feed trigger 170 is inserted between the first and second hand grip pieces 131, 132 and pivotally carried on the interior of the handgrip 130 so that one end of the trigger 170 is aligned against the upper end of the upper clean solution feed rod 172. The upper cord wrap 136 is assembled to the second handgrip piece 132.

The assembly comprising the hand grip 130 and tube 134 is then centrally aligned on the rear shell 120 of the upright handle 100. The assembly comprising the upper clean solution receiver 160, lower clean solution receiver 162, flow valve switch 164, flow valve O-ring 166, flow valve spring 168 and flow valve washer 169 have also been assembled on a lower portion of the rear shell 120, with the lower clean solution feed rod 174 aligned between the switch 164 and the upper rod 172. A clean solution feed tube 350 is attached to an outlet portion on the clean solution receiver 160 and is threaded through the interior of the rear shell 120 toward the bottom of the shell 120 for eventual passage to the floor-traveling head 200. An electrical cord strain relief 124 is oriented axially in a slot 104 in the shells 110, 120 with a electrical cord 178 extending from the exterior of the shell 120 through the strain relief 124 into the interior of the rear shell 120, and electrically connected with a power switch 180. An interconnect harness 179 is connected to the power switch 180 at one end and is threaded through to the lower portion of the rear shell 120 for eventual passage to the floor-traveling head 200. The front shell 110 is then secured over the front of the rear shell 120, the front shell 110 and rear shell 120 mating so as to hold in place those components installed in the rear shell 120. The front shell 110 and the rear shell 120 are typically injection-molded with an internal configuration adapted to receive and hold the various components in place.

The liquid supply tank 140 is assembled by the placement of the fill cap/measure 146 and fill cap O-ring 148 into the fill opening 144, and the placement of the feed valve 152 with siphon tube 151 into the feed opening 150, the feed valve 152 being held in place by the retainer ring 156. The liquid supply tank 140, as assembled, is then ready to be mounted on the rear face of the rear shell 120 by lowering the tank 140 against the rear face of the rear shell 120 and sliding the liquid supply tank mounting rails 156 within liquid supply tank guide rails 118 provided on the rear face of the rear shell 120. As liquid supply tank 140 is lowered against rear shell 120, projection 159 is inserted into upper clean solution receiver 160, with ribs 149 of seal 153 resiliently compressing against the wall of a receiving well in the receiver 160. The interaction between the compressed ribs 149 and the wall creates a resistance against extraction of the valve 152 from receiver 160 and thus resistance against removal of tank 140 from rear shell 120. Tank 140 is further supported by shelf 121.

The assembled upright handle 100 further comprises, on a lower portion of the rear shell 120, a pair of inwardly directed rimmed collars 126. The center of each of these collars includes an aperture 127 for receipt of a pin axle 274 for wheels 272 for the small area deep cleaner 10. Each collar 126 further comprises an arcuate aperture 128 for the passage of the clean solution feed tube 350 on the one hand, and the interconnect harness 179 on the other hand, from the rear shell 120 into the floor-traveling head 200 of the small area deep cleaner 10.

The floor-traveling head 200 is assembled in the following fashion. The motor/impeller assembly 230 is assembled by the attachment of the motor 232 to the rear half of the impeller shell 236, allowing the motor shaft 233 to pass through a central opening in the rear half of the impeller shell 236. The impeller 234 is secured to the motor shaft 233 via a threaded insert molded into impeller 234. Bushing 312 provides a seal at motor shaft 233 on rear half of impeller shell 236. The front half of the impeller shell 236 is then mated with the rear half, enclosing the impeller 234, and with the appropriate seals/bushings in place creating a water-tight enclosure. The motor/impeller assembly 230 is then secured into the base housing 210 with interposed motor mounts 308, 309, 310 adapting motor 232 to molded contours 326 of base housing 210, and held in place by a motor/impeller assembly cover 222 including motor vent apertures 223. Base housing 210 includes a cooling air inlet 325 for passage of cooling air into base housing 210, through motor vent apertures 223 and into the motor/impeller assembly 230, and a motor exhaust 324 for exhaust of cooling air from motor/impeller assembly 230 beneath base housing 210. Motor cooling impeller 232A can thus draw cooling air into motor/impeller assembly 230 through cooling air inlet 325 of base housing 210 and motor vent apertures 223, and exhaust cooling air through motor exhaust 324 to exhaust cooling air from base housing 210. Location of cooling air inlet 325 and exhaust 324 on a lower portion of base housing 210, rather than on an upper surface of floor-traveling head 200, prevents fluids from being spilled into motor/impeller assembly 230 to the detriment of motor 232. A detent lever 216, detent spring 217, and detent lever pin 218 are then assembled to a rear portion of the base housing 210. Bushings 270 are then installed over the collars 126 of the upright handle 100 and wheels 272 are secured to the handle 100 by a pin axle 274 and clip 275 through the apertures 127, the completed upright handle assembly 100 is then mated with the base housing 210 by the placement of each bushing 70 and collar 126 arrangement in semi-circular recesses 212 on the exterior sides of the base housing 210. The clean solution feed tube and electrical cord are now available to the interior of the base housing 210 through the arcuate apertures 128, and are run in channels 322 provided in the molded base housing 210 to their respective destinations, the interconnect harness 179 being run to the motor 232 and the clean solution feed tube being run to the front portion of the base housing 210 for attachment to the nozzle assembly 260. The housing cover 220 is then attached to the base housing 210, the cover 220 comprising among other elements semi-circular recesses 224 on its exterior sides, aligned with the semi-circular recesses of the base housing 220, to encompass the upper half of the collar 126 and bushing 270 of the upright handle 100, thereby pivotally mounting the upright handle 100 to the floor-traveling head 200. Upright handle 100 is maintained in a vertical orientation with respect to floor-traveling head 200 by the action of detent lever 216 preventing upright handle 100 rotating in a rearward direction, and by the abutment of upright handle stops 129 to base housing stops 329 in a frontward direction. Upright handle stops 129 and base housing stops 329 further prevent upright handle 100 from rotating forward and bearing against recovery tank assembly 240.

The nozzle assembly 260 is then assembled to the front portion of the base housing 210, the nozzle 262 carrying on an underside thereof the spray bar 266, fluidly connected to clean solution feed tube 350, spray bar cover 267, and the brush 268. The nozzle lens 264 is mounted to the front of the nozzle 262, forming a portion of a suction channel between the nozzle lens 264 and the nozzle 262. A front portion of the base housing 210 and the rear portion of the nozzle 262 are molded with a channel for the passage of the clean solution feed tube 350 to the spray bar 266. The brush 268 fastens in a removable fashion to the underside of the nozzle 262 by the insertion of integrally molded resilient clips 261 through apertures 263 provided in the nozzle 262. The nozzle gasket 269 nests in a recess formed in an upper portion of the assembled nozzle 262 and nozzle lens 264.

The base housing 210 further comprises a pair of opposing fold-over latches 214 with over-center links 215 for aligning with catches 318 on the sides of the tank assembly 240 for securing the tank assembly 240 to the base housing 210. The floor-traveling head 200 is now ready to receive the removable recovery tank assembly 240.

Assembly of the recovery tank assembly 240 comprises securing the baffle 254 into the upper shell 242 and the insertion of the tank vent 290 into the tank vent opening 250. The tank vent 290 normally carries a foam type filter for the trapping of incidental spray introduced into the tank and to reduce noise generated by the unit. The upper shell 242 is then assembled to the tank lower shell 256 in a sealed fashion to create a water-tight receptacle. The tank lower shell 256 is molded and contoured 320 to nest within the base housing 210. The upper shell 242 is further completed by the attachment of the suction channel cap 248 over the suction channel 246. When the recovery tank assembly 240 is placed within the base housing 210, the suction channel 246 created between the upper shell 242 and the suction channel cap 248 aligns with the suction channel formed between the nozzle 262 and nozzle lens 264, the nozzle gasket 269 providing for a continuous water-tight channel. The recovery tank assembly 240 further comprises, in the upper shell 242, a vertical passage 251 contiguous with the suction channel 246. With the recovery tank assembly 240 secured in place on the floor-traveling head 200, vertical passage 251 aligns with the intake port 238 and the impeller shell 236. Recovery tank assembly 240 is secured to base housing 210 by latches 214, which provide a downward force on recovery tank assembly 240 to create a water-tight seal by intake port gasket 300 between vertical passage 251 and intake port 238, and further create a water-tight seal by output port gasket 306 between second aperture 252 and output port 239. Intake port gasket 300 includes flap 304 which reduces the area of intake port 238, which controls the volume of air flow into the motor/impeller assembly 230 and thereby minimizes the amount of air introduced into the solution. The intake port 238 comprises a conduit with a number of ribs 302 for limiting the debris contained in the flow that passes into the impeller shell 236. The suction channel 246 is therefore fluidly connected with the intake port 238 of the impeller shell 236. The upper shell 242 further comprises a second aperture 252 on a rear portion thereof providing a fluid connection between the tank cavity 258 and the output port 239 of the impeller shell 236 with interposed gasket 306 for providing a fluid seal between output port 239 and second aperture 252. As described above, the vertical passage 251 is fluidly isolated from the tank cavity 258, but, when connected to the intake port 238, is fluidly connected to the tank cavity 258 through the impeller shell 236 and output port 239.

In operation, the motor/impeller assembly 230 is activated by the provision of power to the motor 232 through the power switch 180, creating a suction force at the intake port 238 of the impeller shell 236. This suction force is fluidly connected from the intake port 238 through the suction channel 246 to the portion of the nozzle 262 adjacent to the surface to be cleaned. The circuit of dirty fluid flow runs from the opening of the suction nozzle 262 to the tank cavity 258 through the suction channel 246, vertical passage 251, intake port 238, impeller shell 236, output port 239, and through the second aperture 252 on the rear of the upper shell 242. The flow of dirty solution can be observed by the user through the see-through nozzle lens 264. Dirty water is deposited in the tank cavity 258, with waste air vented from the tank cavity 258 through tank vent 290. The motor 232 has an impeller 232A that draws cooling air through the cooling air inlet 325 located on the bottom of the base housing 210.

Cleaning solution is provided to the surface to be cleaned by depressing the cleaning solution feed trigger 170, which, by action of the upper and lower clean solution feed rods 172, 174 activates the clean solution flow valve switch 164. The upper clean solution receiver 160 receives the projection 159 of the liquid supply tank feed valve 152 through an opening 122 provided in the in the rear shell 120 of the upright handle 100. Clean solution contained in the liquid supply tank 150 is gravity-fed into the clean solution receiver 160, 162, where it is held until the flow valve switch 164 is depressed. Upon depression of the flow valve switch 164, the clean solution flows from the clean solution receiver 160, 162 through a clean solution feed tube 350 to the spray bar 266 where it continues to flow by gravity to the surface to be cleaned.

The suction force provided at the nozzle 262 then extracts the solution, now considered a dirty solution, through the suction channel 246 and into the impeller shell 236. The dirty solution is then expelled from the impeller shell 236 through the output port 239 and into the upper shell 242 and diverter 249 of the recovery tank assembly 240. The dirty solution is directed downwardly into the tank cavity 258 by impinging upon the inner face of the upper shell 242. The dirty solution drops out of the fluid stream as it slows, while the remaining, clean air in the fluid stream is vented from the recovery tank assembly 240 through the tank vent 290. The foam-type filter carried by the tank vent 290, as stated above, captures incident water spray, preventing it from passing through the tank vent 290 and reducing noise from the motor assembly.

The baffle 254 serves the function of dispersing the flow of dirty solution into the recovery tank assembly 240. By dispersing the flow, the baffle 254 prevents the force of the expelled dirty solution from splashing the solution already collected in the tank, reducing the likelihood of excess splatter beyond the capacity of the foam filter, and reducing the formation of foam in the dirty solution.

Figure 5:
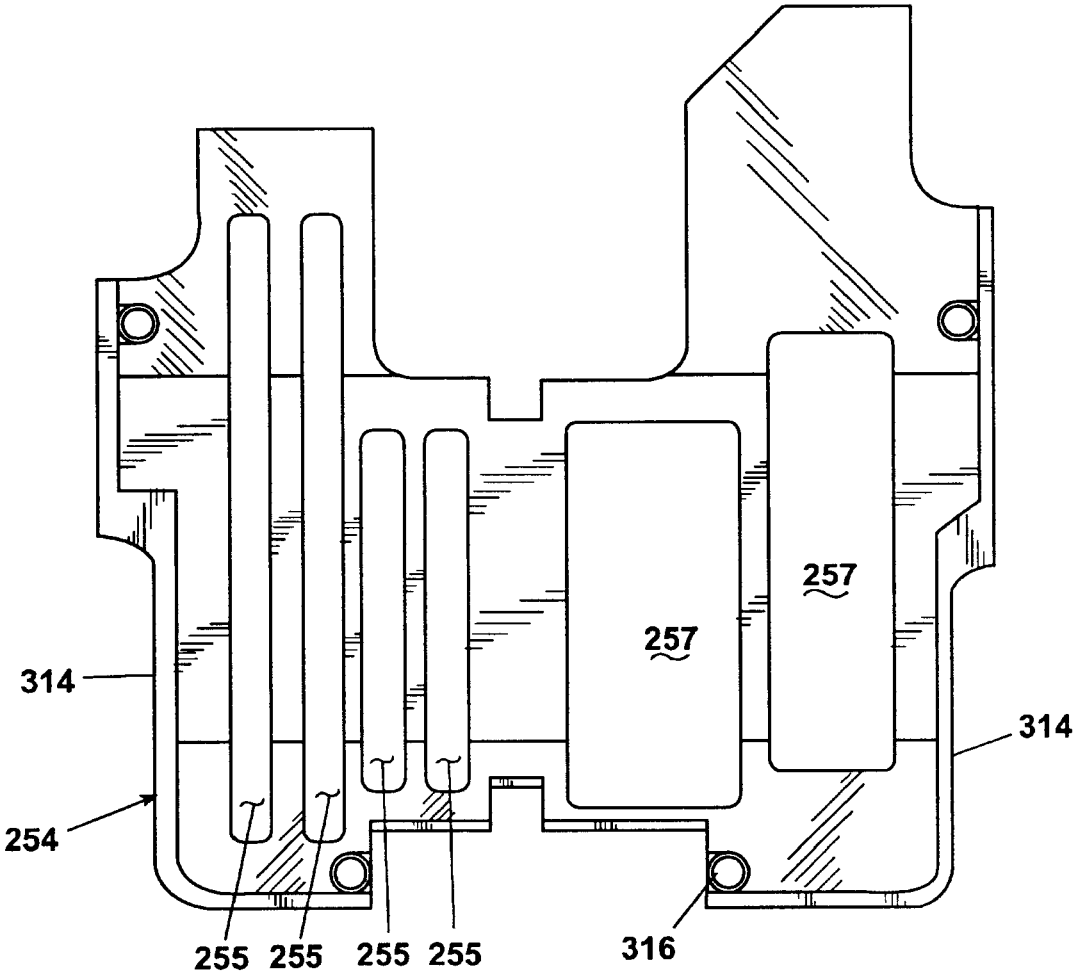
FIG. 5 is a plan view of a baffle from the small area deep cleaner of FIG. 4.

Referring to FIG. 5, the openings in the baffle 254 are graduated, with smaller slots 255 adjacent the second aperture 252 serving to more effectively disperse the force of the solution expelled into the tank, and larger openings 257, remote from the second aperture 252 but adjacent the vent opening 250. Baffle 254 includes outer edge contours 314 for closely conforming to the interior of upper shell 242, and recesses 316 for attaching baffle 254 to upper shell 242 at lugs 317. Upon the recovery tank assembly 240 reaching its capacity of dirty solution, the recovery tank assembly 240 can be removed from the base housing 210 by unlocking the latches 214. The dirty solution in the tank is disposed of by inverting the recovery tank assembly 240 and pouring the dirty solution out of the second aperture 252. Alternatively, the dirty solution is disposed of by removing the tank vent 290 and pouring the dirty solution out through the tank vent opening 250. The larger baffle openings 257 adjacent the tank vent opening 250 make it easier to empty the recovery tank assembly 240.

Figure 6:
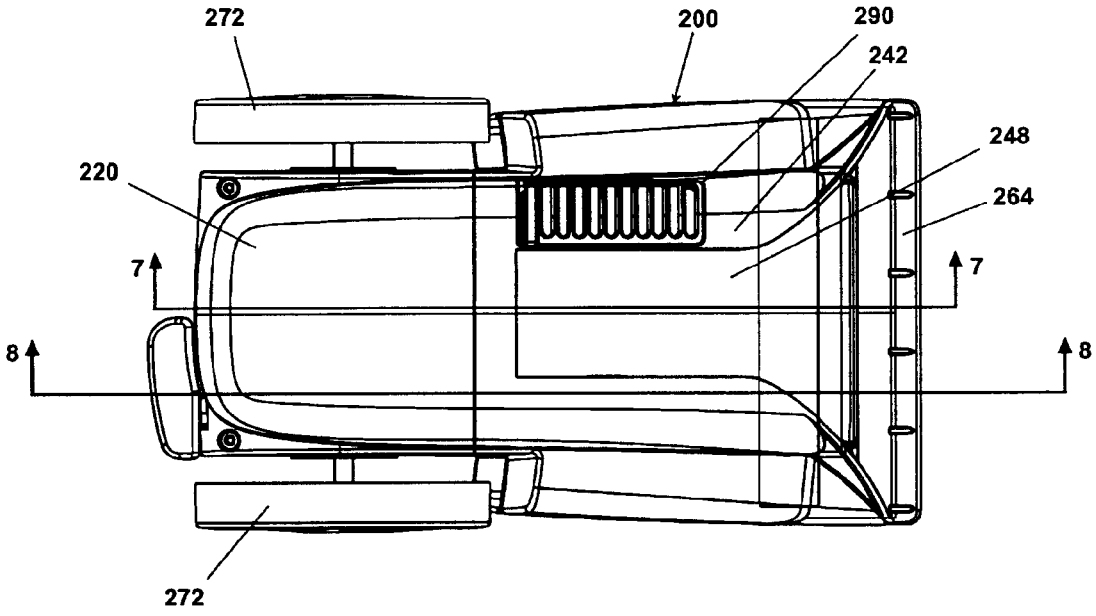
FIG. 6 is a plan view of the floor-traveling head of the small area deep cleaner of FIGS. 1–5.
Figure 7:
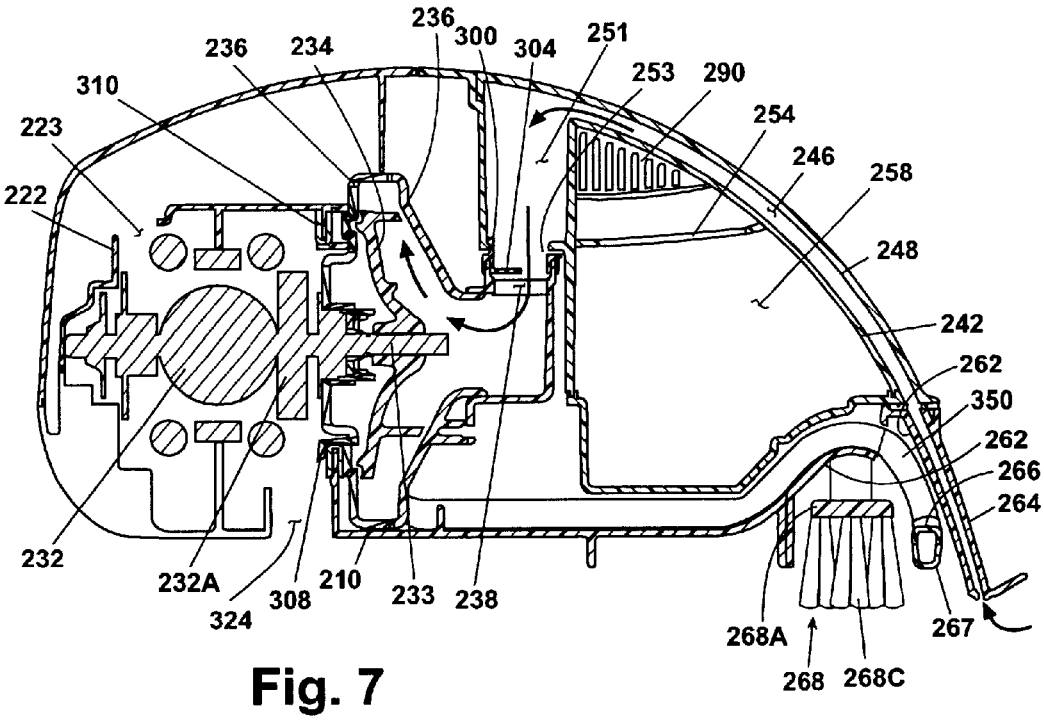
FIG. 7 is a cross-sectional view taken through lines 7—7 of FIG. 6.
Figure 8:
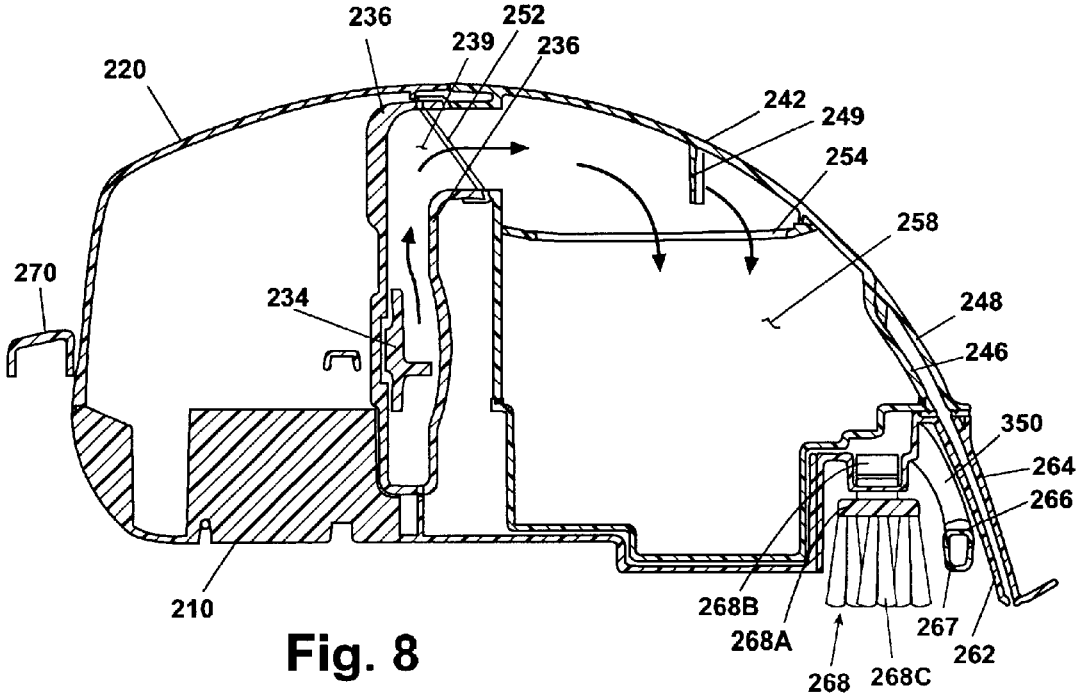
FIG. 8 is a cross-sectional view taken through lines 8—8 of FIG. 6.

FIGS. 6–8 illustrate the relationship of the recovery tank assembly 240 with respect to the base housing 210, and in the cross-sectional view of FIG. 7 illustrates the suction channel 246 passing from the nozzle 262 through the suction channel 246 of the upper shell 242 and into the intake port 238 of the impeller shell 236. FIG. 8 then illustrates the relationship of the output port 239 of the impeller shell 236 to the second aperture 252 in the upper shell 242 above the baffle 254. The arrows indicate the direction of airflow in both FIGS. 7–8.

Figure 9:
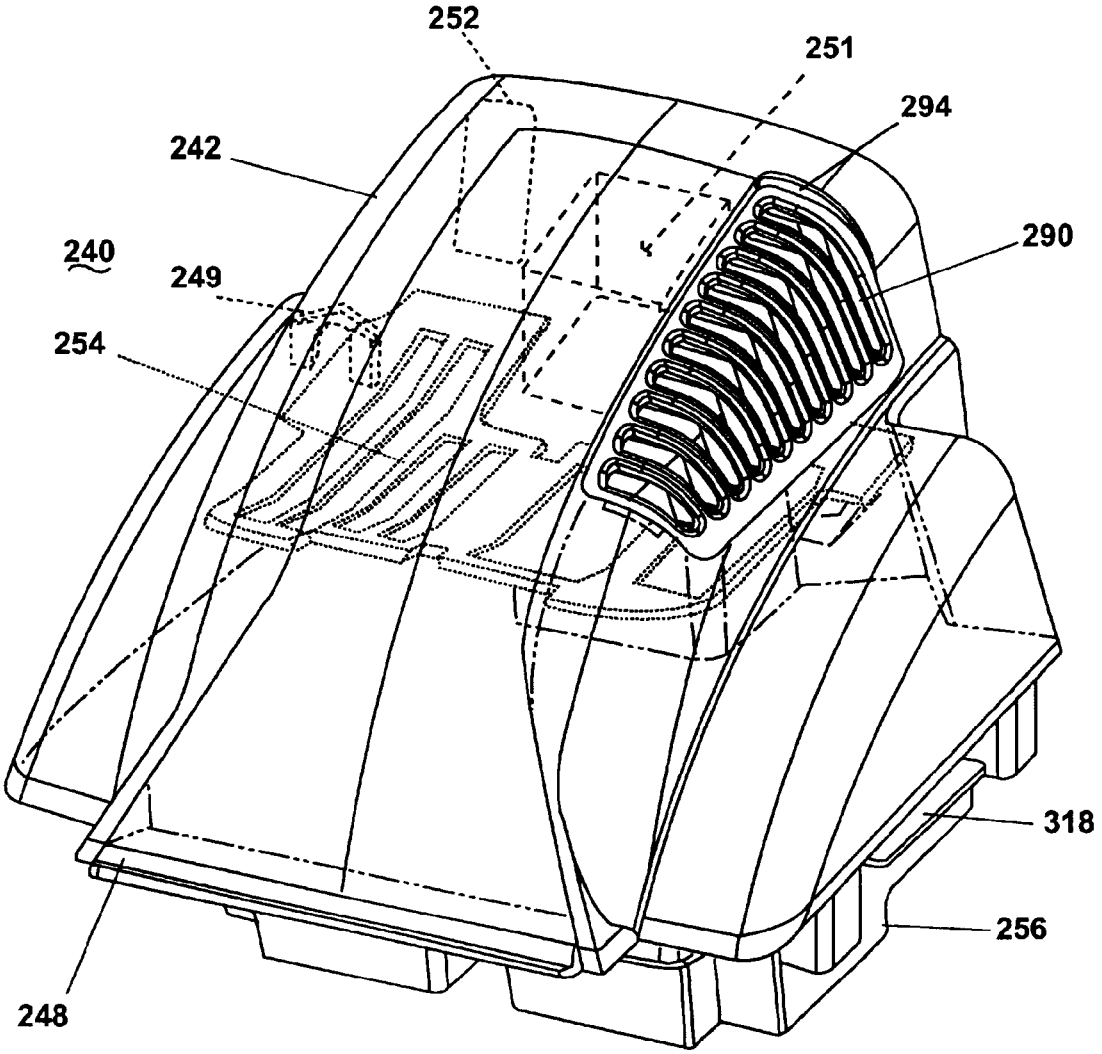
FIG. 9 is a perspective view of a recovery tank from the small area deep cleaner of FIGS. 1–8.
Figure 9A:
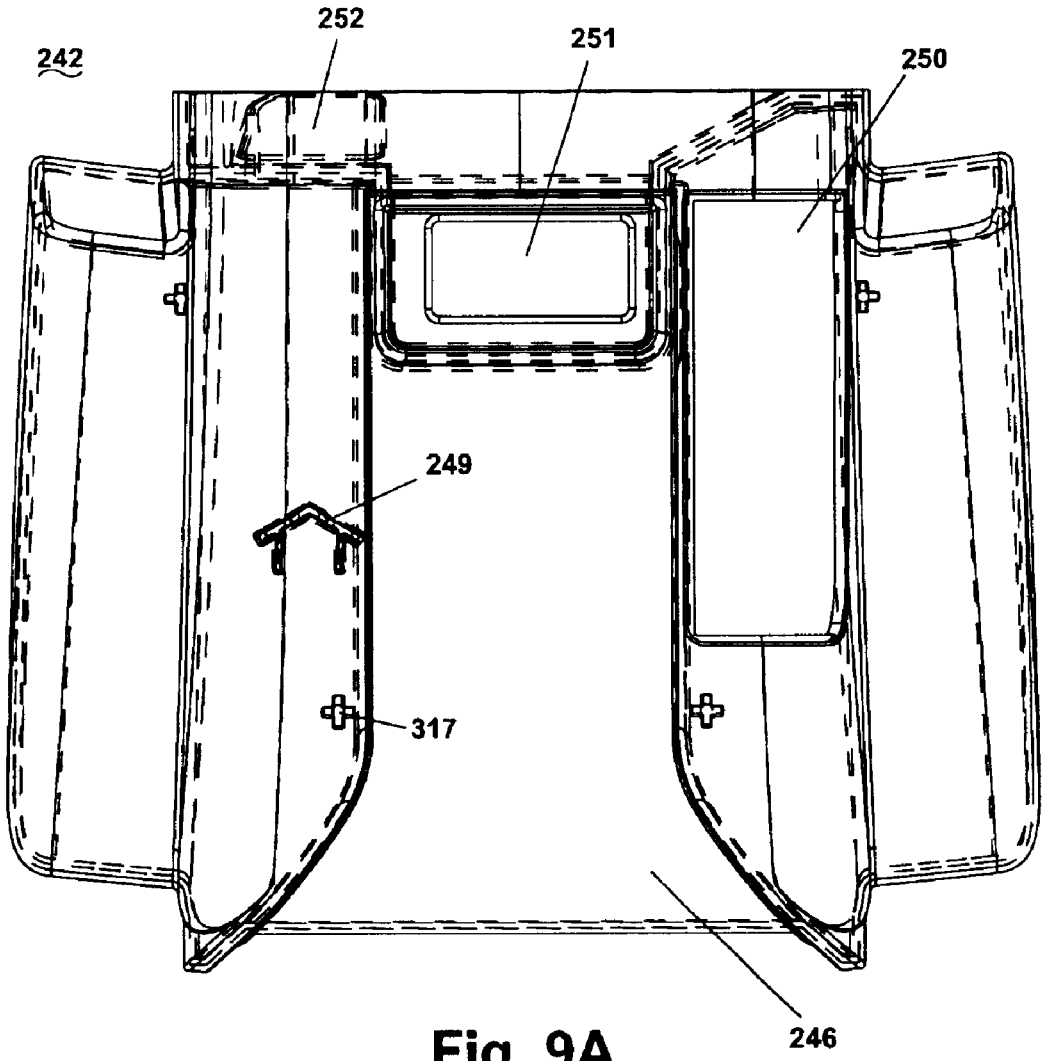
FIG. 9A is a plan view of the recovery collection tank of FIG. 9.

FIG. 9 provides another view of the tank assembly 240 showing the relationship of the baffle 254 and tank vent 290, as well as the second aperture 252 in the upper shell 242 which fluidly connects with the output port 239 of the impeller shell 236. Diverter 249 is also shown in its relationship to the second aperture 252 here and in FIG. 9A, a plan view of the upper shell 242.

Figure 10:
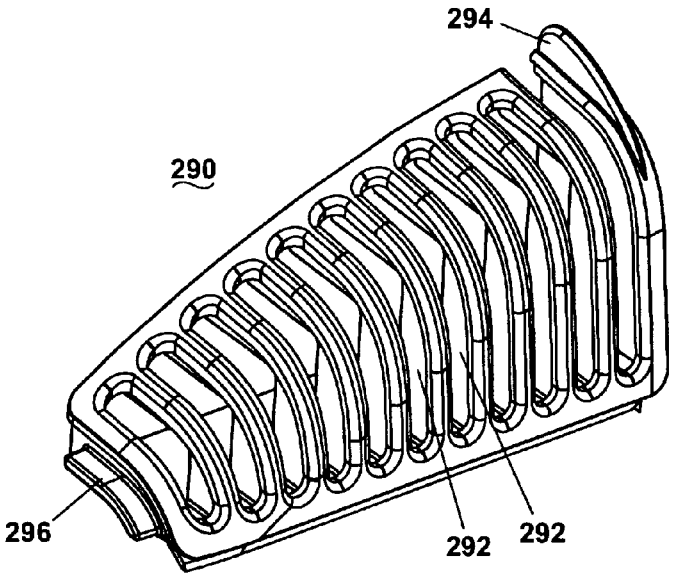
FIG. 10 is a perspective view of a tank vent of the small area deep cleaner of FIGS. 1–9.

The tank vent 290, shown in detail in FIG. 10, is removed from the tank vent opening 250 by applying pressure to the finger tab 294, pulling the edge of the vent 290 away from the edge of the tank opening 250 and relieving the friction between the vent 290 and the opening 250. The vent 290 can then be removed by grasping the finger tab 294 and rotating the vent 290 about the opposing extension 296.

Figure 11:
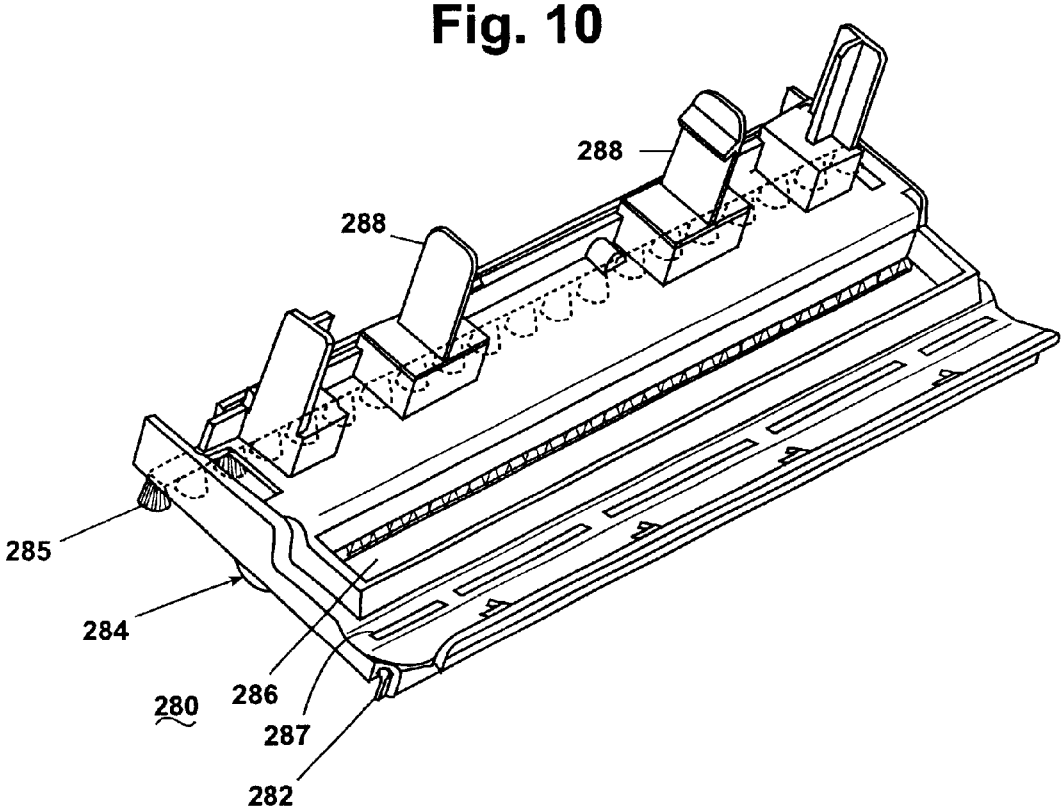
FIG. 11 is a perspective view of a bare floor tool for the small area deep cleaner of FIGS. 1–10.

An additional feature of the small area deep cleaner 10 according to the invention is a bare floor tool 280 shown in perspective in FIG. 11. The bare floor tool 280 is generally rectangular in plan view and removably clips in place on the underside of the nozzle 262, in place of the brush 268. The bare floor tool 280 includes a pair of resilient molded clips 288 for insertion in the same apertures 263 of the nozzle 262 that receive the clips 261 of the brush 268. The bare floor tool 280 comprises a reinforced sponge 284, parallel to and between a squeegee 282 located along the front edge, and a plurality of bristles 285 located along a back edge. Between the squeegee 282 and the sponge 284 lies a line of slit apertures 287 and an elongate central opening 286. The bare floor tool 280 is configured so that, when installed in place of the brush 268, the suction nozzle 262 will be aligned with the slit apertures 287, and the spray bar 266 will direct cleaning solution to the surface to be cleaned through the central opening 286. The leading edge of the floor-traveling head 200 will therefore have a squeegee 282 against the floor, followed by the slit apertures 287 with nozzle 262 therein, spray bar 266 within the central opening 286, the sponge 284 somewhat compressed against the floor, and the brush 285 in operative contact with the floor. The brush 285 provides a scrubbing action on the bare floor, the sponge 284 serving the purpose of even fluid distribution and some degree of scrubbing, and the squeegee 282 scraping water from the surface to be extracted by the nozzle 262. The extension of the squeegee 282, sponge 284, and brush 285 beyond the face of the opening 286 and in contact with the floor, prevent the nozzle 262 from contacting and scratching, or being damaged by, the bare floor.

While the invention has been specifically described in connection with certain specific embodiments thereof, it is to be understood that this is by way of illustration and not of limitation. Reasonable variation and modification are possible within the scope of the forgoing description and drawings without departing from the spirit of the invention which is defined in the appended claims.

What is claimed is:

1. A portable surface cleaning apparatus, comprising:

a base housing having a front portion and a rear portion adapted for movement along a surface to be cleaned;

an upright handle with a front side facing the front portion of the base housing and a rear side facing the rear portion of the base housing, the upright handle pivotally mounted to the rear portion of the base module;

a liquid dispensing system comprising:

a liquid dispenser associated with the base module for applying liquid to a surface to be cleaned;

a liquid supply tank removably mounted to the handle for holding a supply of cleaning liquid;

a liquid supply conduit fluidly connected to the liquid supply tank and to the dispenser for supplying liquid to the dispenser;

a liquid recovery system comprising:

a recovery tank removably mounted on the base housing having a liquid recovery chamber for holding recovered liquid;

a suction nozzle associated with the base housing and adapted to draw dirty liquid from the surface to be cleaned;

a working air conduit extending between the recovery chamber and the suction nozzle;

a vacuum source in fluid communication with the recovery chamber for generating a flow of working air from the nozzle through the working air conduit and through the recovery chamber to thereby draw dirty liquid from the surface to be cleaned through the nozzle and working air conduit, and into the recovery chamber to thereby recover the dirty liquid from the surface to be cleaned;

the improvement comprising:

a supply tank mounting assembly on the rear side of the handle and on a front side of the liquid supply tank for removably mounting the liquid supply tank to the rear side of the handle.

2. A portable surface cleaning apparatus according to claim 1 wherein the supply tank mounting assembly comprises a pair of spaced mounting rails on the rear side of the handle; and a pair of spaced mounting rails on the liquid supply tank adapted to interface with the handle mounting rails to slidably mount the liquid supply tank to the rear side of the handle.

3. The portable surface cleaning apparatus according to claim 2 and wherein the supply tank includes an outlet opening in a lower portion thereof and a cap removably mounted in the outlet opening, and further comprising a siphon tube mounted in the cap and having a free end distal from the cap, the siphon tube is bent into a shape so that the free end of the siphon tube is adjacent a side wall at a low point in the interior of the tank when the handle is tilted in use.

4. The portable surface cleaning apparatus according to claim 3 and further comprising a vent hole in the liquid supply tank at an upper portion of the front side thereof.

5. The portable surface cleaning apparatus according to claim 4 wherein the liquid supply tank has an elongated shape in a vertical direction when the handle is in an upright position and smoothly conforms to the shape of the handle to an appearance of being integrated therewith.

6. The portable surface cleaning apparatus according to claim 5 wherein the liquid supply tank front side has a relatively flat front portion and the handle has a recessed rear wall complementary to the flat front portion of the liquid supply tank, and the relatively flat front portion of the supply tank front side is received in the recessed rear wall of the handle.

7. The portable surface cleaning apparatus according to claim 6 wherein a rear wall of the liquid supply tank has a concave outward shape.

8. The portable surface cleaning apparatus according to claim 7 wherein a front face of the supply tank has a fill opening at a central portion thereof whereby the supply tank can be filled while oriented horizontally.

9. The portable surface cleaning apparatus according to claim 8 and further comprising a fill cap removably mounted in the fill opening, the fill cap having on an interior end a cavity that has a predetermined capacity related to a predetermined volume in the liquid supply tank whereby the fill cap serves as a measure for a cleaning solution that is added to a predetermined volume of clean water in the liquid supply tank to form a solution of a desired concentration in the liquid supply tank.

10. The portable surface cleaning apparatus according to claim 9 wherein the liquid supply tank has measuring indicia on the tank to indicate when the tank has the predetermined volume.

11. The portable surface cleaning apparatus according to claim 10 wherein the measuring indicia comprises a mark on an upper portion of a wall of the liquid supply tank to indicate the predetermined volume when the tank is in an upright position.

12. The portable surface cleaning apparatus according to claim 11 wherein the measuring indicia further comprises a mark in a vertical direction along a side wall of the liquid supply tank near the front side thereof to indicate the predetermined volume when the tank is in a horizontal fill position.

13. The portable surface cleaning apparatus according to claim 12 wherein the supply tank is at least partially transparent or translucent so that the level of the liquid in the tank can be observed by an operator.

14. The portable surface cleaning apparatus according to claim 10 wherein the measuring indicia comprises a mark in a vertical direction along a side wall of the liquid supply tank near the front side thereof to indicate the predetermined volume when the tank is in a horizontal fill position.

15. The portable surface cleaning apparatus according to claim 14 wherein the supply tank is at least partially transparent or translucent so that the level of the liquid in the tank can be observed by an operator.

16. The portable surface cleaning apparatus according to claim 10 wherein the supply tank is at least partially transparent or translucent so that the level of the liquid in the tank can be observed by an operator.

17. The portable surface cleaning apparatus according to claim 1 wherein the supply tank includes an outlet opening in a lower portion thereof and a cap removably mounted in the outlet opening and further comprising a siphon tube mounted in the cap and having a free end distal from the cap, the siphon tube is bent into a shape so that the free end of the siphon tube is adjacent a side wall of the supply tank at a low point in the interior of the tank when the handle is tilted in use.

18. The portable surface cleaning apparatus according to claim 1 wherein the liquid supply tank has an elongated shape in a vertical direction when the handle is in an upright position and smoothly conforms to the shape of the handle to an appearance of being integrated therewith.

19. The portable surface cleaning apparatus according to claim 1 wherein the liquid supply tank front side has a relatively flat front portion and the handle has a recessed rear wall complementary to the flat front portion of the liquid supply tank, and the relatively flat front portion of the supply tank front side is received in the recessed rear wall of the handle.

20. The portable surface cleaning apparatus according to claim 19 wherein a rear wall of the liquid supply tank has a convex outward shape.

21. The portable surface cleaning apparatus according to claim 1 wherein the front side of the liquid supply tank has a fill opening at a central portion thereof whereby the supply tank can be filled while oriented horizontally.

22. The portable surface cleaning apparatus according to claim 21 and further comprising a fill cap removably mounted in the fill opening, the fill cap having on an interior end a cavity that has a predetermined capacity related to a predetermined volume in the liquid supply tank whereby the fill cap serves as a measure for cleaning solution that is added to a predetermined volume of clean water in the liquid supply tank to form a solution of a desired concentration in the liquid supply tank.

23. The portable surface cleaning apparatus according to claim 22 wherein the liquid supply tank has measuring indicia on the tank to indicate when the tank has the predetermined volume.

24. A portable surface cleaning apparatus, comprising:

a base housing adapted for movement along a surface to be cleaned;

an upright handle pivotally mounted to the base module;

a liquid dispensing system comprising:

a liquid dispenser associated with the base module for applying liquid to a surface to be cleaned;

a liquid supply tank for holding a supply of cleaning liquid, the liquid supply tank has an elongated shape in a vertical direction when the handle is in an upright position and further has an elongated side wall;

a liquid supply conduit fluidly connected to the liquid supply tank and to the dispenser for supplying liquid to the dispenser;

a liquid recovery system comprising:

a recovery tank removably mounted on the base housing having a liquid recovery chamber for holding recovered liquid;

a suction nozzle associated with the base housing and adapted to draw dirty liquid from the surface to be cleaned;

a working air conduit extending between the recovery chamber and the suction nozzle;

a vacuum source including a vacuum motor in fluid communication with the recovery chamber for generating a flow of working air from the nozzle through the working air conduit and through the recovery chamber to thereby draw dirty liquid from the surface to be cleaned through the nozzle and working air conduit, and into the recovery chamber to thereby recover the dirty liquid from the surface to be cleaned;

the improvement comprising:

the elongated side wall has a fill opening at a central portion thereof whereby the supply tank can be filled while oriented horizontally.

25. The portable surface cleaning apparatus according to claim 24 and further comprising a fill cap removably mounted in the fill opening, the fill cap having on an interior end a cavity that has a predetermined capacity related to a predetermined volume in the liquid supply tank whereby the fill cap serves as a measure for a cleaning solution that is added to a predetermined volume of clean water in the liquid supply tank to form a solution of a desired concentration in the liquid supply tank.

26. The surface cleaning apparatus according to claim 24 wherein the liquid supply tank has measuring indicia on the tank to indicate when the tank has the predetermined volume.

27. The portable surface cleaning apparatus according to claim 26 wherein the measuring indicia comprises a mark on an upper portion of a wall of the liquid supply tank to indicate the predetermined volume when the tank is in an upright position.

28. The portable surface cleaning apparatus according to claim 27 wherein the measuring indicia further comprises a mark in a vertical direction along a wall of the liquid supply tank near the elongated side wall thereof to indicate the predetermined volume when the tank is in a horizontal fill position.

29. The portable surface cleaning apparatus according to claim 28 wherein the supply tank is at least partially transparent or translucent so that the level of the liquid in the tank can be observed by an operator.

30. The portable surface cleaning apparatus according to claim 26 wherein the measuring indicia comprises a mark in a vertical direction along a wall of the liquid supply tank near the elongated side wall thereof to indicate the predetermined volume when the tank is in a horizontal fill position.

31. The portable surface cleaning apparatus according to claim 30 wherein the supply tank is at least partially transparent or translucent so that the level of the liquid in the tank can be observed by an operator.

32. The portable surface cleaning apparatus according to claim 26 wherein the supply tank is at least partially transparent or translucent so that the level of the liquid in the tank can be observed by an operator.

* * * * *